US007128569B2

(12) United States Patent
Little

(10) Patent No.: US 7,128,569 B2
(45) Date of Patent: Oct. 31, 2006

(54) WELDING TORCH STRIKER WITH SAFETY STOPPER

(76) Inventor: Lawrence C. Little, 7 Rolling Green Dr., Apt. E, Fall River, MA (US) 02720

( * ) Notice: Subject to any disclaimer, the term of this patent is extended or adjusted under 35 U.S.C. 154(b) by 25 days.

(21) Appl. No.: 10/827,140

(22) Filed: Apr. 19, 2004

(65) Prior Publication Data

US 2004/0197721 A1 Oct. 7, 2004

(51) Int. Cl.
*F23D 14/46* (2006.01)
*F23D 1/00* (2006.01)
*F23Q 1/02* (2006.01)

(52) U.S. Cl. ..... 431/274; 431/343; 431/353

(58) Field of Classification Search ..... 431/129, 431/273, 274, 343, 356; 224/197, 666, 669, 224/680, 269, 904; 206/349–383
See application file for complete search history.

(56) References Cited

U.S. PATENT DOCUMENTS

| | | | | | |
|---|---|---|---|---|---|
| 1,441,251 | A | * | 1/1923 | Steffens | 2/161.6 |
| 1,969,677 | A | | 8/1934 | Stowell | |
| 2,325,506 | A | * | 7/1943 | Grace | 206/223 |
| 3,239,057 | A | * | 3/1966 | Manz | 206/380 |
| 3,516,585 | A | * | 6/1970 | Inwood | 224/584 |
| 3,637,120 | A | | 1/1972 | Clay | |
| 4,080,157 | A | | 3/1978 | Albertson et al. | |
| 4,363,432 | A | | 12/1982 | Warthen | |
| 4,496,088 | A | * | 1/1985 | Tuthill | 224/683 |
| D280,258 | S | | 8/1985 | Miller | |
| 4,595,136 | A | * | 6/1986 | Cooper | 228/57 |
| 4,961,523 | A | | 10/1990 | Stimac | |
| 5,388,740 | A | * | 2/1995 | Garland | 224/675 |
| 5,501,382 | A | * | 3/1996 | Webb | 224/673 |
| 5,538,418 | A | | 7/1996 | Stinnett | |
| 5,664,712 | A | | 9/1997 | Smrt | |
| 5,839,633 | A | | 11/1998 | Fisher | |
| 6,085,952 | A | * | 7/2000 | Garland | 224/243 |
| D433,229 | S | * | 11/2000 | Harker et al. | D3/228 |
| 6,196,382 | B1 | | 3/2001 | Lenderman | |
| D451,276 | S | * | 12/2001 | Nigh | D3/228 |
| D464,793 | S | | 10/2002 | Anderton | |
| D468,092 | S | | 1/2003 | Anderton | |
| 6,910,578 | B1 | * | 6/2005 | Stern | 206/379 |
| 2002/0008128 | A1 | | 1/2002 | Field | |

* cited by examiner

*Primary Examiner*—Alfred Basichas
(74) *Attorney, Agent, or Firm*—John L. Lee

(57) ABSTRACT

A novel safety stopper for use with a conventional welding torch striker includes a sleeve made of a flexible, non-inflammable, heat-resistant material. The sleeve is shaped to enclose a central portion of both arms of a conventional welding torch striker, while allowing relative movement first and second push-tabs. The sleeve is retained on the arms by spring force. The sleeve is shaped to cover a substantial portion of the open area defined by the arms and the strike plate, while exposing the strike plate and the flint. A novel welding torch striker includes an integral safety stopper made of a flexible, non-flammable, heat-resistant rubber and formed as a web, a first handle-grip, and a second handle-grip. The stopper extends between both arms of the striker with the first handle-grip surrounding a portion of the first arm and the second handle-grip surrounding a portion of the second arm.

35 Claims, 15 Drawing Sheets

WELDING TORCH STRIKER WITH SAFETY STOPPER

CROSS REFERENCE TO RELATED APPLICATIONS

This application claims priority to co-owned, U.S. application Ser. No. 10/735,175, filed Dec. 12, 2003, now abandoned that claims priority to co-owned U.S. provisional application Ser. No. 60/438,834, field Jan. 9, 2003.

BACKGROUND OF THE INVENTION

Field of the Invention

This invention relates generally to safety improvements in hand tools that construction workers carry on their belt for use on a construction site.

Some construction workers on site carry tools hanging low from their belt. Welders and fabricators, in particular, carry hanging from their belt a welding torch striker (i.e. spark lighter) of the type used to light an oxy-acetylene torch for "burning" or cutting metal. The strike plate and arms of a typical prior art striker defines an elongated open area that has a tendency to catch on protruding objects, for example re-bar, steel cable, etc., or posts, hooks, etc., protruding from equipment. A striker catching on a protruding object can throw the construction worker off-balance. This tendency to catch on protruding objects poses a significantly safety hazard to a construction worker who is working on a partially constructed bridge or high-rise building.

SUMMARY OF THE INVENTION

The invention provides a welding torch striker safety stopper that in various embodiments may be used with a conventional welding torch striker, or may be incorporated into a novel welding torch striker.

A conventional welding torch striker has a substantially U-shaped spring handle. The spring handle defines a first arm with a first push-tab and a second arm with a second push-tab. The arms are formed as one piece with a bend at a proximal end of the striker. A striker plate is mounted to a distal end of the first arm, and a flint is mounted to a distal end of the second arm. The spring handle and the strike plate define an open area that tends to catch on protruding objects.

A first preferred embodiment of a safety stopper for use with a conventional welding torch striker includes a sleeve made of a flexible, non-flammable, heat-resistant material. The sleeve is shaped to enclose a central portion of both arms, while providing space for relative movement within the sleeve of the first push-tab with respect to the second push-tab. The sleeve is shaped and sized for retention on the arms by enclosing a central portion of both arms, whereby spring force may be exerted outward on the sleeve by the arms. The sleeve is shaped to cover a substantial portion of the open area, while exposing the strike plate and the flint. When the striker, with the safety stopper attached, is carried hands-free attached to an operator's belt, the safety stopper reduces the chances of the operator being thrown off balance by the striker catching on an external object.

In the first preferred embodiment of the safety stopper for use with a conventional welding torch striker, the sleeve is preferably formed of a single sheet of leather folded to produce a fold and first and second open edges, the first and second open edges attached by stitching.

In the first preferred embodiment of the safety stopper for use with a conventional welding torch striker, the bend at the proximal end of the striker preferably protrudes beyond the proximal end of the safety stopper.

The first preferred embodiment of the safety stopper for use with a conventional welding torch striker preferably includes at least one pouch attached to the sleeve.

In another embodiment, a safety stopper for use with a conventional welding torch striker is shaped as a sock. The sock is attached to the striker by a grommet penetrating the sock near the sock's proximal closed end, and by at least one rivet penetrating the sock near the sock's distal open end.

Another embodiment of a safety stopper for use with a conventional welding torch striker includes a rigid plate made of a non-flammable, heat-resistant material, and two clip-on fasteners adapted to clip the rigid plate to the spring handle.

Another embodiment of a safety stopper for use with a conventional welding torch striker includes a single rigid plate defining at least one peripheral groove on a first long edge of the plate, and an overlapping portion along a second long edge of the plate.

Another embodiment of a safety stopper for use with a conventional welding torch striker includes two rigid plates configured for clamp-on attachment of the plates to the striker, a first rigid plate having at least one integral spacer and a second rigid plate having at least one socket sized to accept the at least one integral spacer.

Another embodiment of a safety stopper for use with a conventional welding torch striker includes a rigid metal plate tack-welded to one of the two arms, and mounted in sliding, overlapping relationship to the other one of the two arms.

A first preferred embodiment of a novel welding torch striker includes an integral safety stopper and a substantially U-shaped spring handle. The spring handle defines a first arm with a first push-tab and a second arm with a second push-tab. The arms are formed as one piece with a bend at a proximal end of the striker. A strike plate is mounted to a distal end of the first arm, the spring handle and the strike plate defining an open area. A flint is mounted to a distal end of the second arm. A safety stopper is mounted to the spring handle and is configured to cover a substantial portion of the open area, while exposing the strike plate and the flint.

When the striker, with its integral safety stopper, is carried hands-free attached to an operator's belt, the safety stopper reduces the chances of the operator being thrown off balance by the striker catching on an external object.

The first preferred embodiment of a novel welding torch striker includes a safety stopper formed as a one-piece integral safety stopper including a web, a first handle-grip, and a second handle-grip. The web extends between the first handle-grip and the second handle-grip. The first handle-grip surrounds a portion of the first arm and the second handle-grip surrounds a portion of the second arm.

The first preferred embodiment of a novel welding torch striker includes an integral safety stopper made of a flexible, non-flammable, high-temperature resistant rubber.

The first preferred embodiment of a novel welding torch striker includes an integral safety stopper made by injection molding.

The first preferred embodiment of a novel welding torch striker further comprises at least one pouch formed as part of the one-piece integral safety stopper.

An alternative embodiment of a novel welding torch striker further comprises at least one pouch made of leather attached to the integral safety stopper.

In another alternative embodiment, the welding torch striker with safety stopper includes a safety stopper shaped as a sock attached to the spring handle by a fastener penetrating the sock near the sock's closed end and passing through the coil of the spring handle.

In another alternative embodiment, the welding torch striker with safety stopper is a rigid plate attached to one of the first and second arms such that the rigid plate may move in sliding, overlapping relationship to the other arm of the first and second arms.

In another alternative embodiment, the rigid plate is a metal plate tack-welded to the one of the first and second arms.

In another alternative embodiment, the safety stopper includes two rigid plates clamped onto the striker.

BRIEF DESCRIPTION OF THE DRAWINGS

FIG. 9 (prior art) shows the Pearson model 2001 striker.

FIG. 10 (prior art) shows a cartridge containing spare flints for the Pearson model 2001 striker.

FIG. 11 (prior art) shows a spring latch used to hang a striker from the construction worker's belt or hammer strap.

FIG. 12 (prior art) shows the tip cleaner of FIGS. 7A and 7B folded.

FIG. 13 (prior art) shows a tip cutter used to flatten the end of a burner tip.

FIG. 14 (prior art) shows a Pearson model 4501 striker.

FIG. 15 (prior art) shows the triple-flint mount used in the Pearson model 4501.

DETAILED DESCRIPTION OF THE INVENTION

The invention provides a safety stopper for use with a conventional striker or spark lighter of the type used by welders and fabricators to light torches, and also a novel welding torch striker incorporating a safety stopper.

Figure 1:
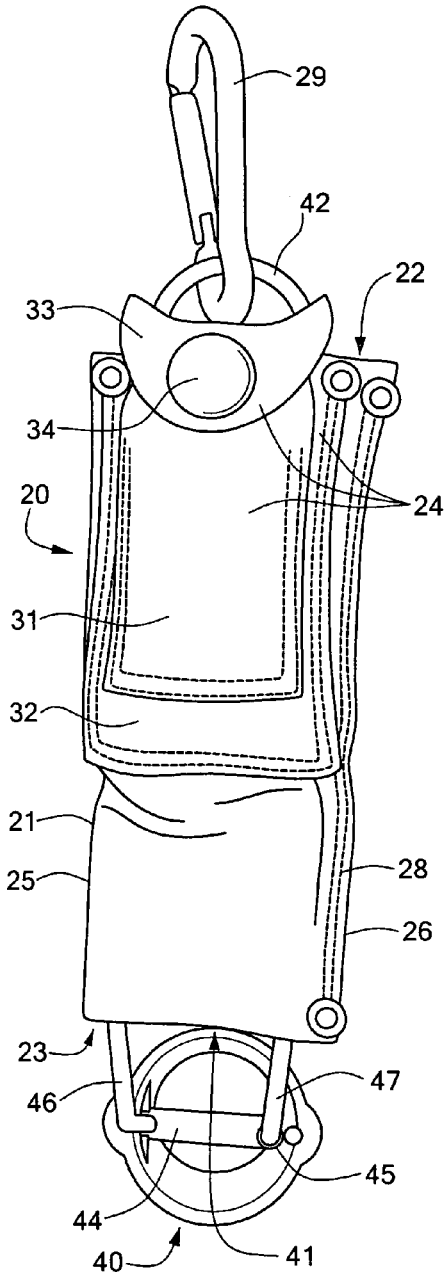
FIGS. 1 and 2 are drawings that show front view and rear view, respectively, of a safety stopper comprising a sleeve for use with a Pearson model 2001 striker in accordance with a first preferred embodiment of the invention.
Figure 2:
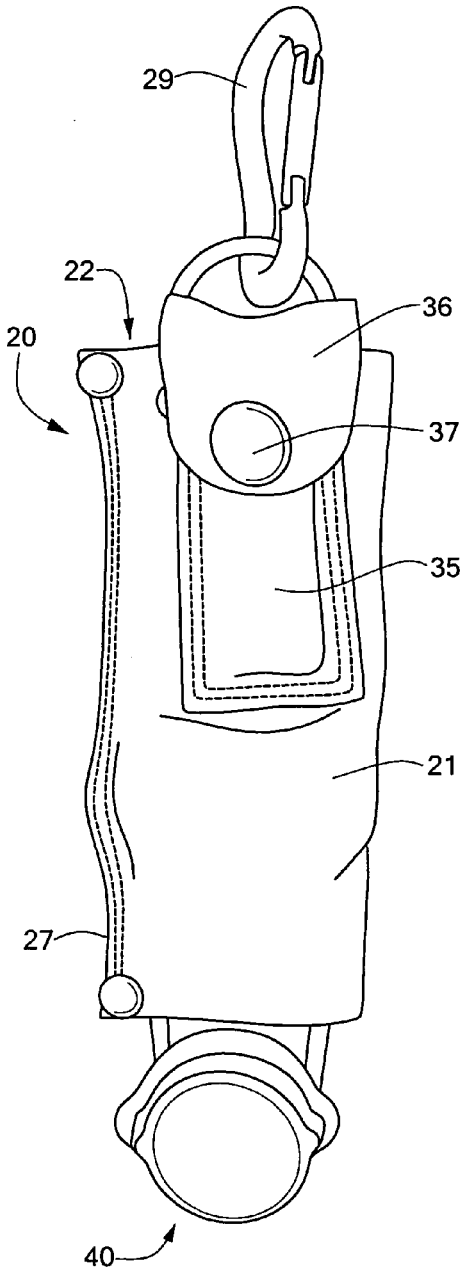

FIG. 1 is a front view of a first preferred embodiment of a safety stopper for use with a conventional welding torch striker, safety stopper 20, in accordance with the invention. FIG. 2 is a rear view of a safety stopper 20 of FIG. 1.

Figure 3:
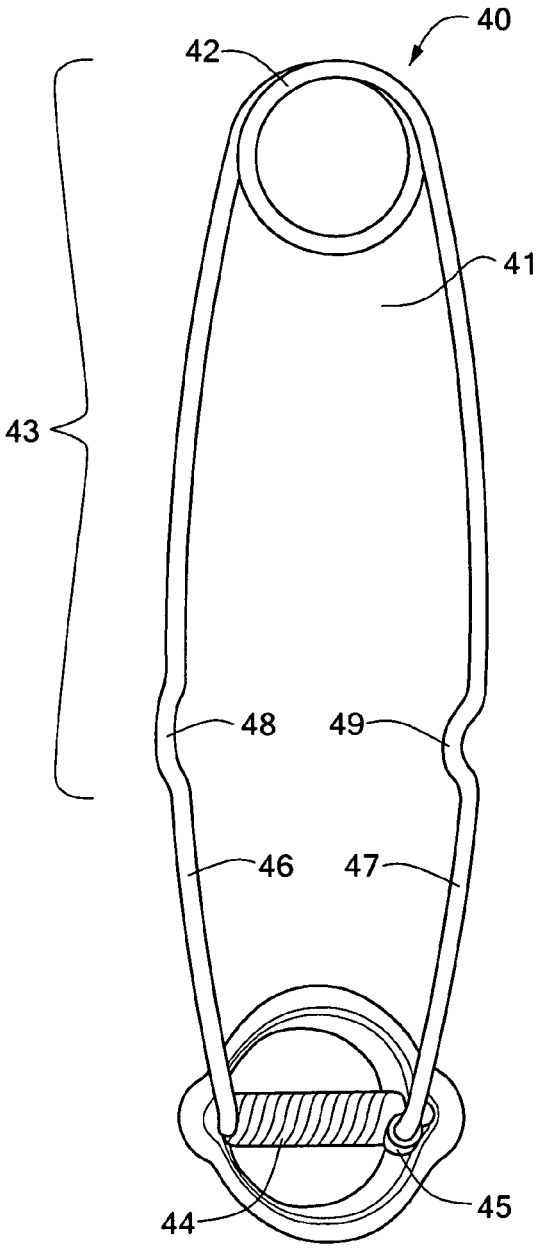
FIG. 3 PRIOR ART
FIGS. 3 and 4 (both prior art) show a front and side view of a Pearson model 2001 striker.
Figure 4:
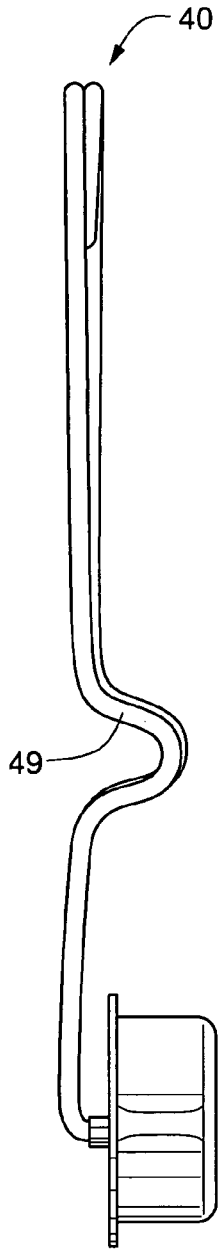
FIG. 4 PRIOR ART

The Pearson model 2001 striker 40 (prior art) is shown in front view and side view, respectively, in FIGS. 3 and 4. FIG. 3 shows striker 40 having a substantially U-shaped spring handle 43 defining a proximal handle region including first arm 46 with a first push-tab 48 and a second arm 47 with a second push-tab 49, the arms joined to form a bend 42 at a proximal end of the striker. At the distal end of the striker, flint 45 is mounted to the distal end of first arm 46, and strike plate 44 is mounted to the distal end of second arm 47. The spring handle and the strike plate define elongated open area 41. Elongated open area 41, shown in FIG. 3 as being defined by arms 46 and 47 and strike plate 44 of the striker, is the source of the hazard that is addressed by the invention.

Returning to FIG. 1, safety stopper 20 includes an elongated cover 21 having a tough outer face, herein below referred to "sleeve portion 21". Sleeve portion 21 is shaped to substantially cover elongated open area 41. Front face 24 of safety stopper 20 prevents protruding objects in the environment in which the worker operates from entering and catching on the sides of elongated open area 41. By doing so, it reduces the chances of the striker catching on an external object, thus providing a safety feature.

Front face 24, including the exposed part of sleeve portion 21 and the exposed parts of pouches 31 and 32, has a smooth, tough outer face. Sleeve portion 21, at least the portion between fold 25 and first and second open edges 26 and 27, is made of a flexible, non-flammable, heat-resistant material such as leather. First open edge 26 and second open edge 27 are attached by stitching 28.

As illustrated in FIG. 3, bend 42 of the model 2001 striker is a coil spring. In other versions of the striker, bend 42 could be a simple half-turn bend rather than the coil spring of the model 2001 striker. Herein below bend 42 is also referred to as "coil spring 42". The term "bend" is used in the claims to include either "bend" or "coil spring".

Referring to FIG. 1, proximal opening 22 in sleeve portion 21 allows coil spring 42 of the model 2001 striker to produce. This permits the striker to be suspended from spring latch 29. Spring latch 29, as shown again in FIGS. 5 and 6, may hook onto hammer strap 55 or onto the construction worker's belt 56.

Referring again to FIG. 1, a distal opening 23 in elongated cover (sleeve) 21 allows the strike plate and flint to protrude beyond distal opening 23 of sleeve 21.

Figure 5:
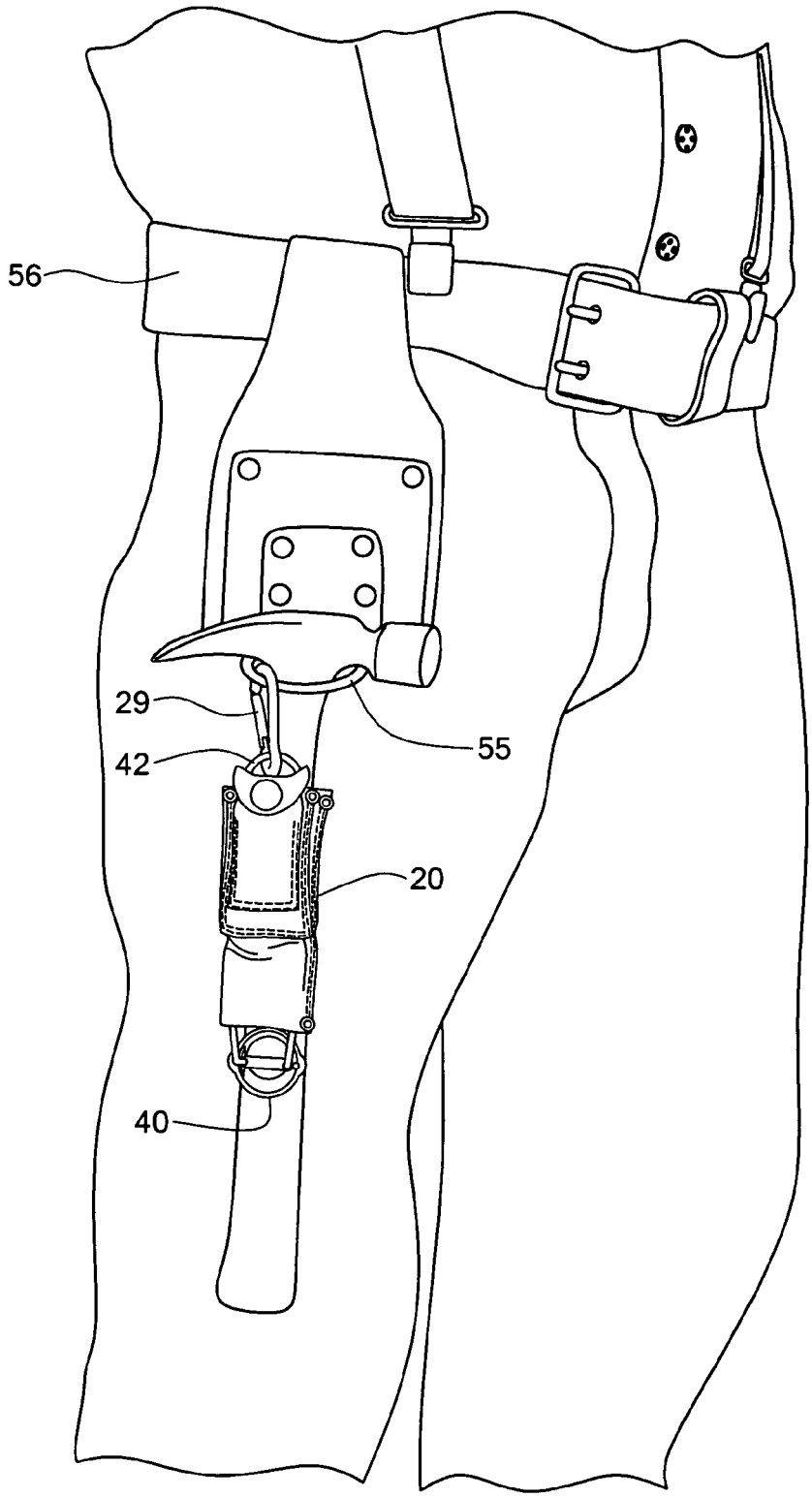
FIG. 5 shows a Pearson model 2001 striker blocked by the safety stopper of FIGS. 1 and 2, as the striker would be carried by a construction worker.
Figure 6:
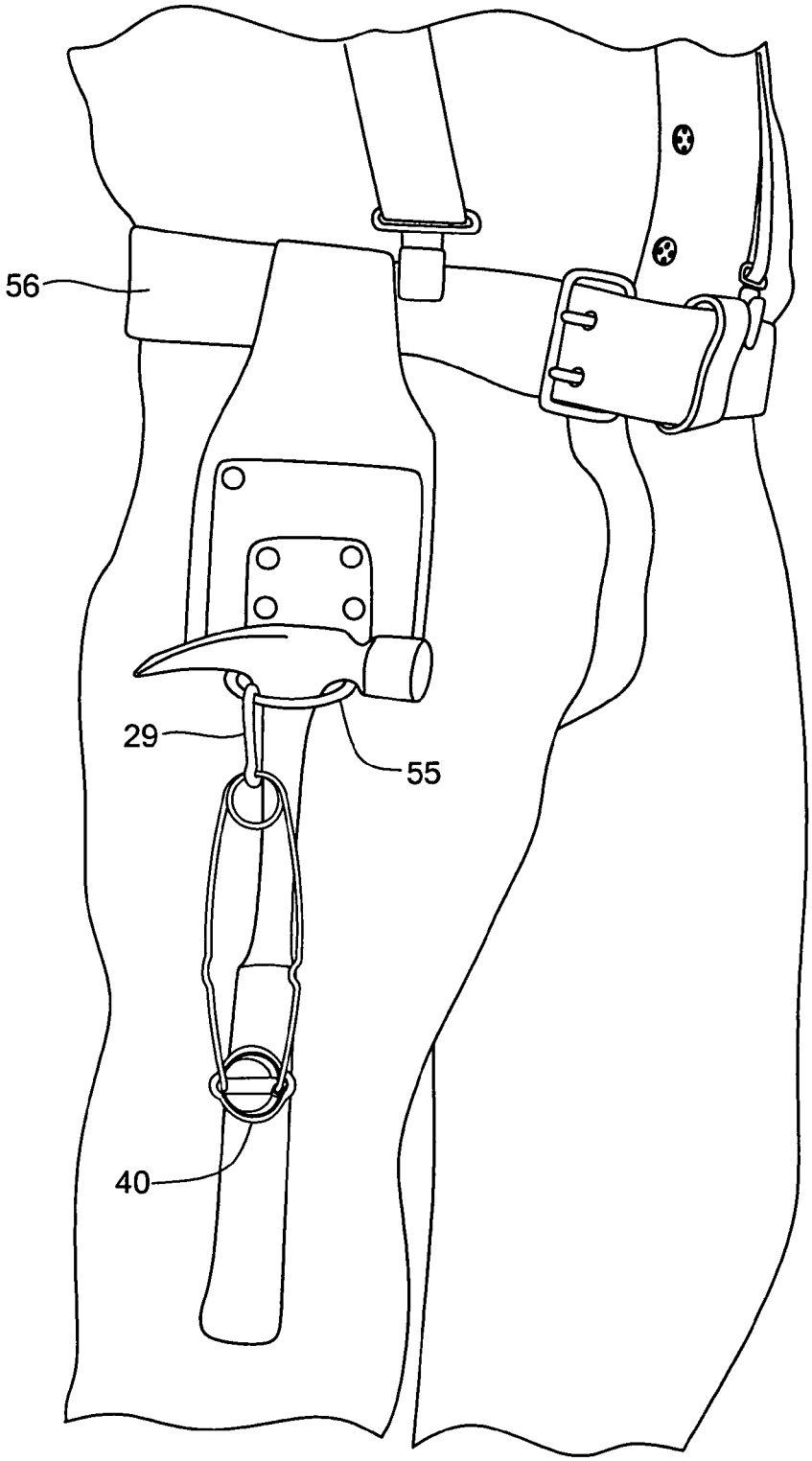
FIG. 6 PRIOR ART
FIG. 6 (prior art) shows a Pearson 2001 striker as typically carried by a construction worker.

FIG. 5 shows a Pearson model 2001 striker 40 with safety stopper 20 suspended from a construction worker's hammer strap 55. It can be seen that this permits the striker to be used to re-light a torch burner without needing to unhook the striker. Additionally, the flexibility of sleeve 21 shown in FIG. 1, and protrusion of the strike plate and flint beyond distal opening 23, also shown in FIG. 1, permits the striker to be used to re-light a torch burner without needing to remove or retract the sleeve. The flexibility of the sleeve allows push tabs 48 and 49 on first and second arms 46 and 47 (shown in FIG. 3) to be pushed together within the sleeve by the operator's hand outside the sleeve. FIG. 6 (prior art) shows a Pearson model 2001 striker 40, without a safety stopper, suspended from the construction worker's hammer strap.

As illustrated in FIGS. 1 and 2, safety stopper 20 includes pouches 31, 32 and 35, preferably mounted front and rear, for storing striker accessories. Outer front pouch 31 and inner front pouch 32 are both closed by front flap 33 having a press-stud fastener 34. Rear pouch 35 is closed by rear flap 36 having a press-stud fastener 37.

Figure 9:
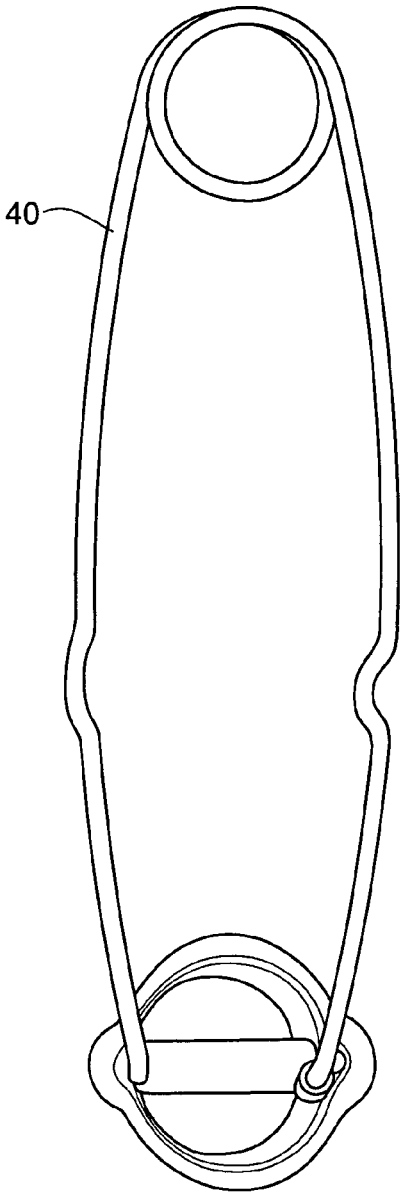
FIG. 9 PRIOR ART
FIGS. 9–15 (prior art) show the relative size of various items associated with strikers used with the invention.
Figure 10:
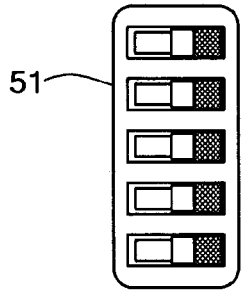
FIG. 10 PRIOR ART
Figure 11:
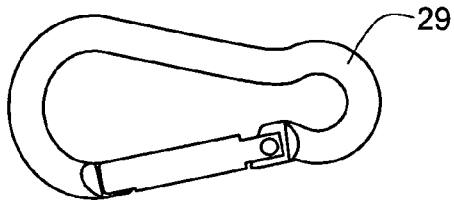
FIG. 11 PRIOR ART
Figure 12:
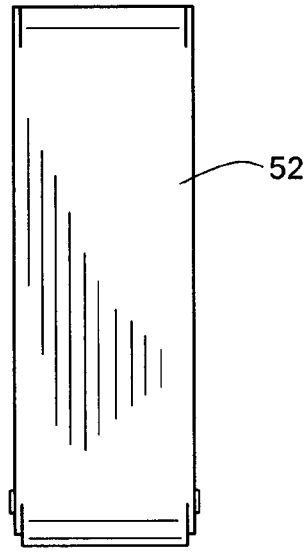
FIG. 12 PRIOR ART
Figure 14:
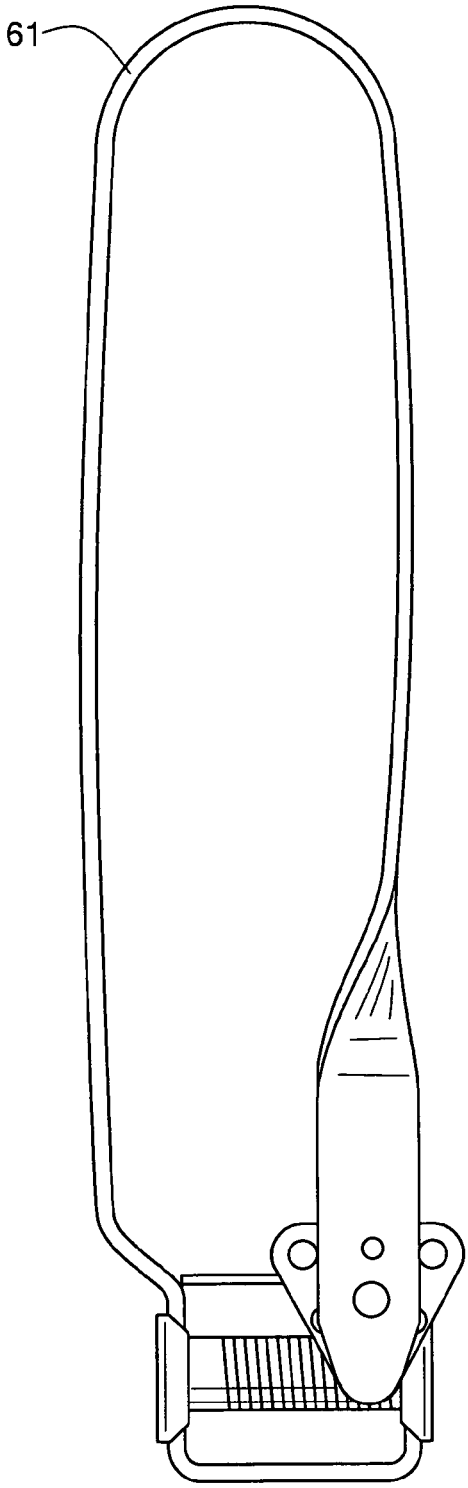
FIG. 14 PRIOR ART
Figure 15:
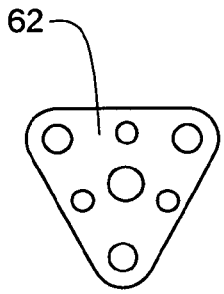
FIG. 15 PRIOR ART

The Pearson model 2001 striker 40 is drawn to scale in FIG. 9, and its accessories are shown in FIGS. 10 to 13 drawn to the same scale to show their relative size. Likewise, the Pearson model 4501 striker 61 is drawn to scale in FIG. 14 and its triple-flint mount 62, shown i FIG. 15, is drawn to the same scale to show its relative size.

Figure 7:
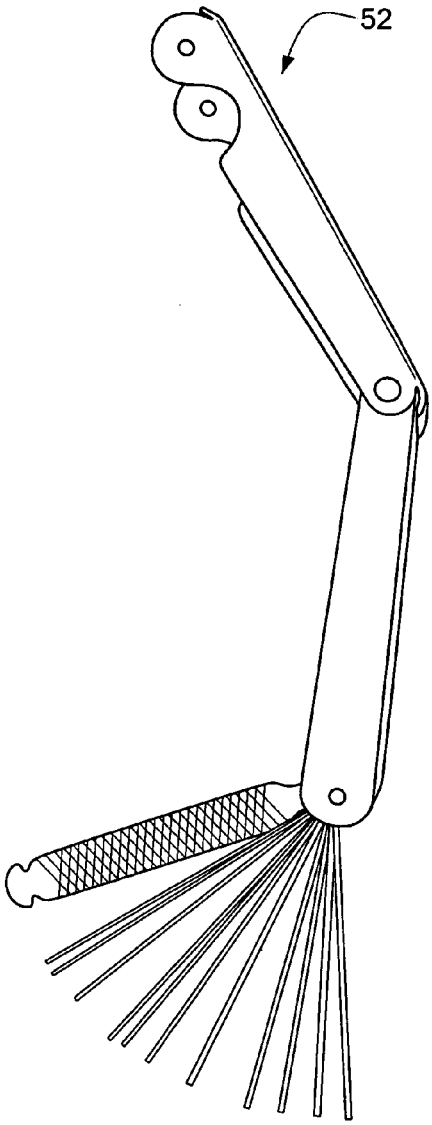
FIG. 7 PRIOR ART
FIGS. 7 and 8 (prior art) show side and front views respectively of a Lawson products tip cleaner that may be carried in a pouch of the safety stopper of FIGS. 1 and 2.
Figure 8:
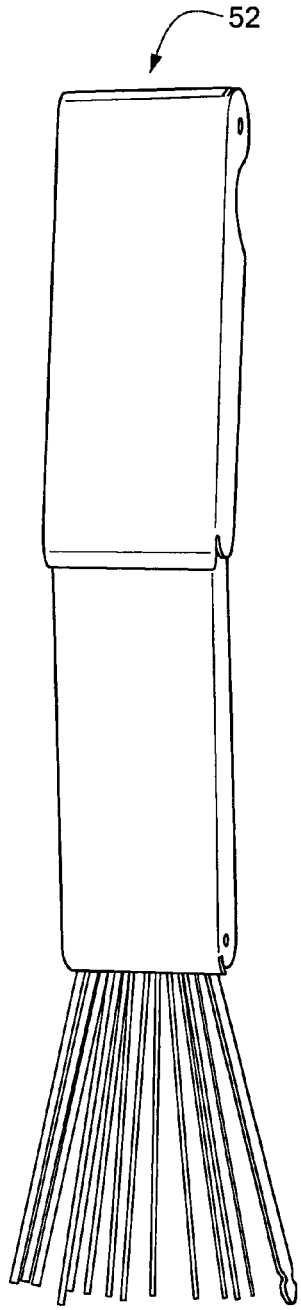
FIG. 8 PRIOR ART
Figure 13:
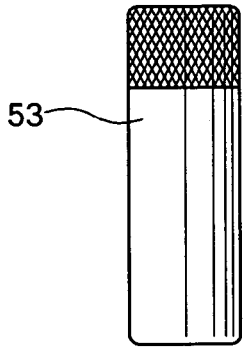
FIG. 13 PRIOR ART

Accessories of Pearson model 2001 striker 40 include a spare flints cartridge, a tip cleaner, and a tip cutter. Spare flints cartridge 51 is shown containing five spare flints in FIG. 10. Tip cleaner 52 is illustrated in FIGS. 7 and 8, and is shown folded in FIG. 12. Tip cutter 53 is illustrated in FIG. 13. Tip cleaner 52 and tip cutter 53 may be used with either the Pearson model 2001 striker 40 or the Pearson model 4501 striker 61.

Figure 16:
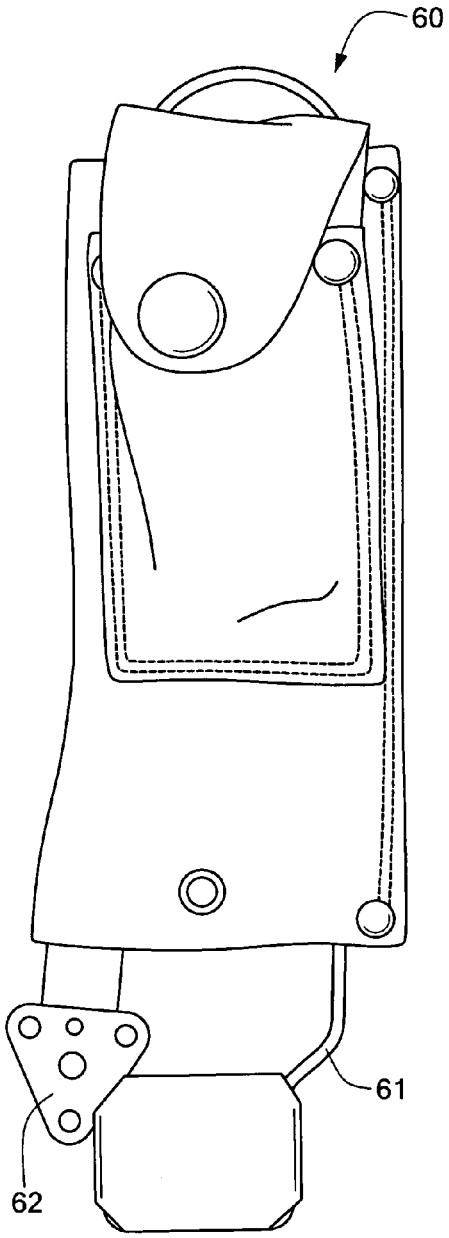
FIG. 16 is a front view of a second embodiment of a safety stopper for use with a Pearson model 4501 striker having a triple-flint mount.
Figure 17:
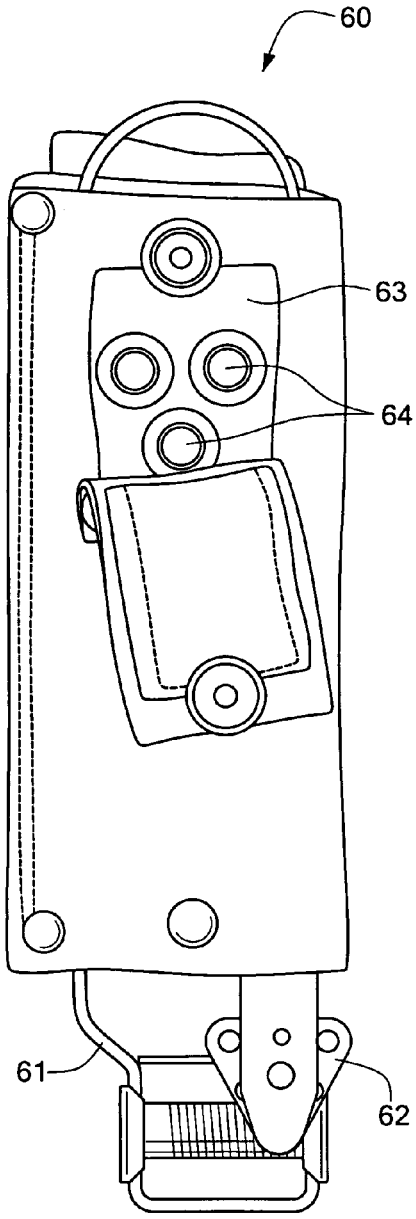
FIG. 17 is a rear view of the safety stopper of FIG. 16 with the flint mount pouch open to show detail.

Safety stopper 60, substantially covering a Pearson model 4501 striker 61 in accordance with a second embodiment of the invention, is shown in FIGS. 16 and 17. FIG. 16 shows the front face of the safety stopper with the front pouches closed. FIG. 17 shows the rear face of the safety stopper with the rear pouch open.

FIGS. 16 and 17 show the Pearson model 4501 striker 61 having a triple-flint mount 62. FIG. 17 shows flint-mount pouch 63, having socket 64 for holding a triple-flint mount. Safety stopper 60 is shaped to allow for replacement of the triple-flint mount 62 of the striker 61 without the need to remove or retract the shield.

Figure 18:
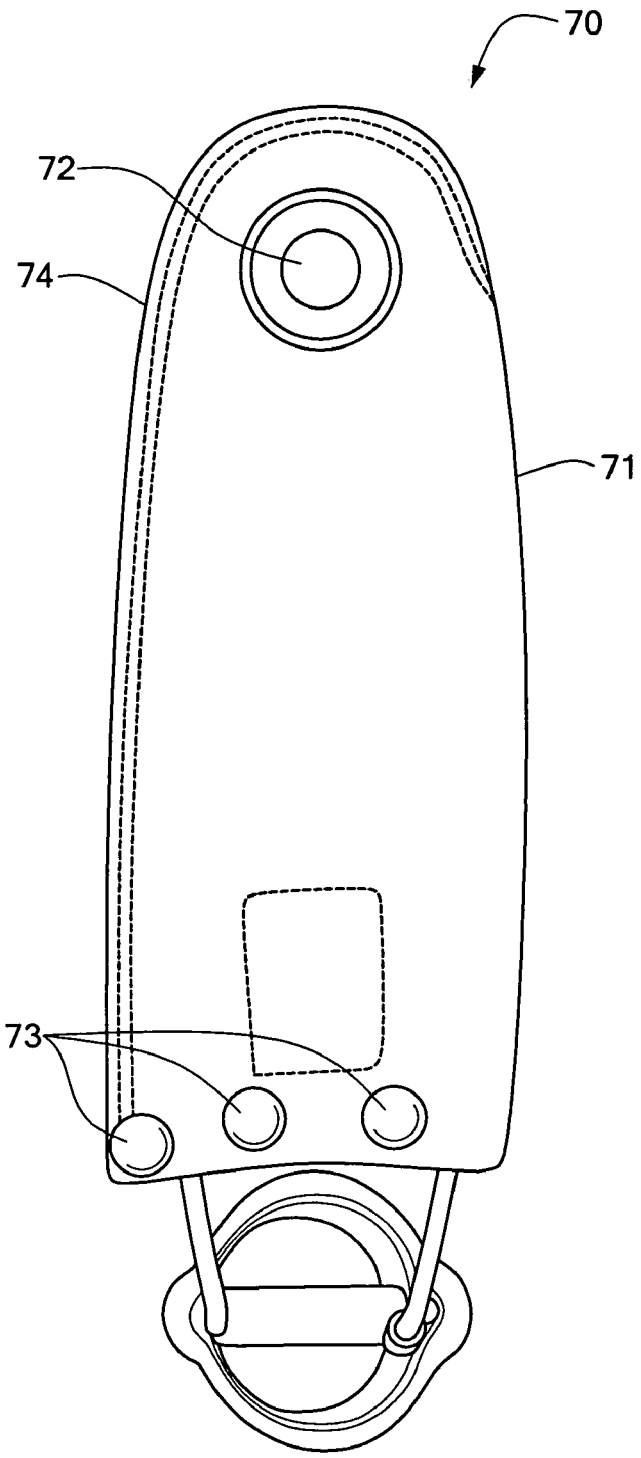
FIG. 18 is a front view of a third embodiment of a safety stopper having a cover shaped as a sock.

A third embodiment of a safety stopper is illustrated in FIG. 18. This third embodiment has an elongated cover shaped as a sock and made of a flexible, non-flammable, heat-resistant material. FIG. 18 is a front view of safety stopper 70 having a sock portion 71, a grommet 72 at the proximate closed end of the sock end of the striker, the grommet positioned within the bend of the striker. Preferably, the third embodiment also includes a plurality of rivets 73 penetrating the distal open end of the sock. Preferably, the sock includes stitching 74 along one side and around the distal end of the sock.

This third embodiment may also include pockets.

The front face of safety stopper 70, including the exposed part of sock portion 71 and the exposed parts of front pouches, if any, has a smooth, tough outer face. Sock portions 71 is made of a flexible, non-flammable, heat-resistant material such as leather.

Figure 19:
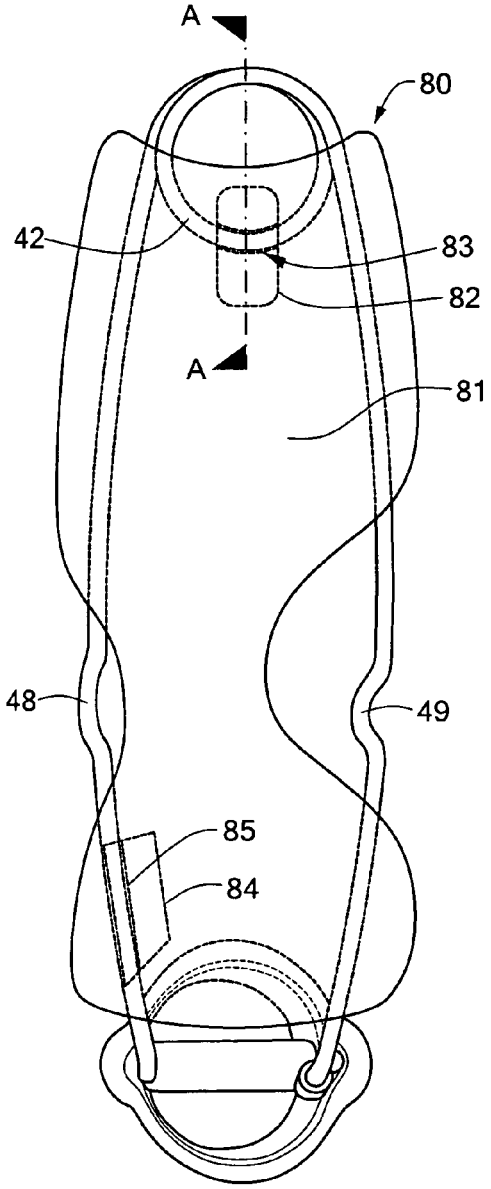
FIG. 19 is a front view of a fourth embodiment of a safety stopper comprising a single rigid clip-on plate.
Figure 20:
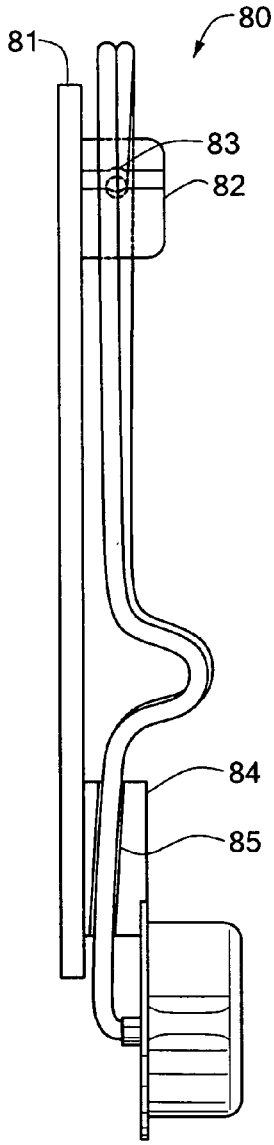
FIG. 20 is a side view of the safety stopper of FIG. 19.

A fourth embodiment of a safety stopper is illustrated in FIGS. 19 and 20. This fourth embodiment has a single rigid clip-on plate portion. FIG. 19 is a front view of safety stopper 80 having a single rigid clip-on plate 81. Safety stopper 80 includes proximal clip-on fastener 82 and distal clip-on fastener 84, both preferably integrally molded with plate 81 to form safety stopper 80. Proximal clip-on fastener 82 defines proximal slot 83, and distal clip-on fastener 84 defines distal slot 85.

The front face of safety stopper 80, essentially the front face of plate 81, has a smooth, tough outer face. Plate 81, is made of a rigid, non-inflammable, heat-resistant material such as a molded thermo-setting plastic material.

Figure 21:
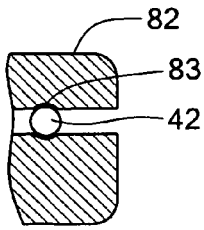
FIG. 21 is a cross-section view along A—A of the safety stopper of FIG. 19.

FIG. 20 is a side view of safety stopper 80. FIG. 19 locates proximal clip-on fasteners 82, proximal slot 83, distal clip-on fastener 84, and distal slot 85. FIG. 21, a cross-section view across A—A of the safety stopper of FIG. 19 shows detail of proximal slot 83.

Figure 22:
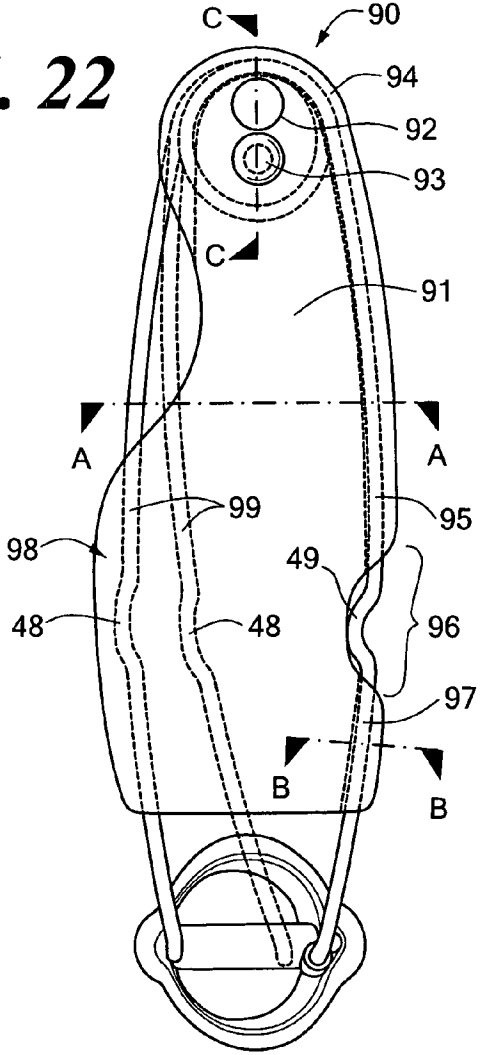
FIG. 22 is a front view of a fifth embodiment of a safety stopper including a single rigid plate having a peripheral groove adapted to secure the proximal end of the rigid plate within the bend of the striker.

A fifth embodiment of a safety stopper is illustrated in FIGS. 22–26. In this firth embodiment, as shown in FIG. 22, safety stopper 90 includes a single rigid plate 91 defining at least one peripheral groove on a first long edge of the plate, and an overlapping portion along a second long edge of the plate. Preferably, rigid plate 91 is made of stiff leather. The area of the plate covering the coil spring of the striker is split in the plane of the striker to form deep peripheral groove 94 in the proximal end of plate 91. In a plane transverse to the plane of the striker the same area defines a first aperture 92 for accommodating a spring latch, and defines a second aperture for accepting rivet 93. (Alternatively, a grommet through a single aperture could be used). Deep peripheral groove 94 extends as a proximal shallow peripheral groove 95 along a first long edge of the plane 91. Distal shallow peripheral groove 97 is separated from shallow peripheral groove 95 by slot 96 to accommodate second push-tab 49. Overlapping portion 98 of plate 91 overlaps swinging arm 99 of the striker to allow movement of a first push-tab 48.

Figure 23:
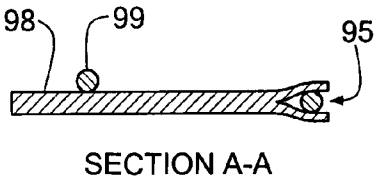
FIG. 23 is a cross section view across A—A of FIG. 22.
Figure 24:
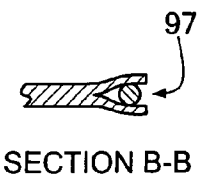
FIG. 24 is a partial cross section view across B—B of FIG. 22.

FIG. 23 is a section view across A—A of FIG. 22 showing overlapping portion 98 of plate 91, swinging arm 99, and proximal shallow peripheral groove 95 in cross-section. FIG. 24 is a partial cross-section near the distal end of safety stopper 90 showing distal shallow peripheral groove 97 in cross-section.

Figure 25:
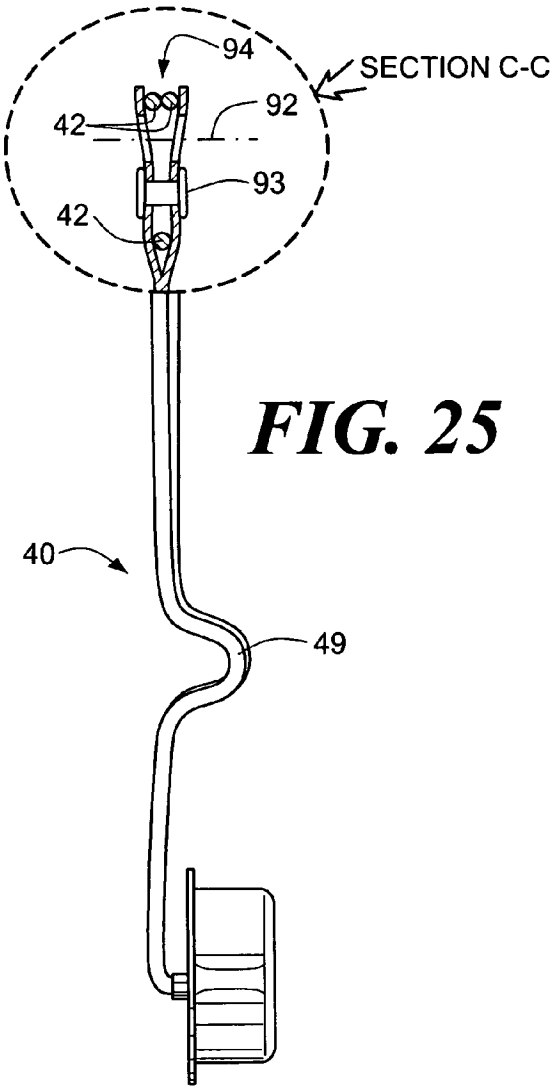
FIG. 25 is a side view of part of striker 40, with a partial cross section view across C—C of FIG. 22 (of the proximate end of safety stopper 90).

FIG. 25 is a side view of striker 40 with a partial cross section of the proximate end of safety stopper 90 showing deep peripheral groove 94 and bend 42 (in this case coil spring) in cross-section.

Figure 28:
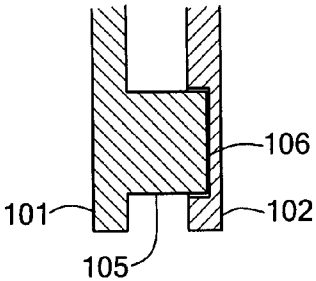
FIG. 28 is a partial cross-section of the safety stopper across B—B of FIG. 26.
Figure 27:
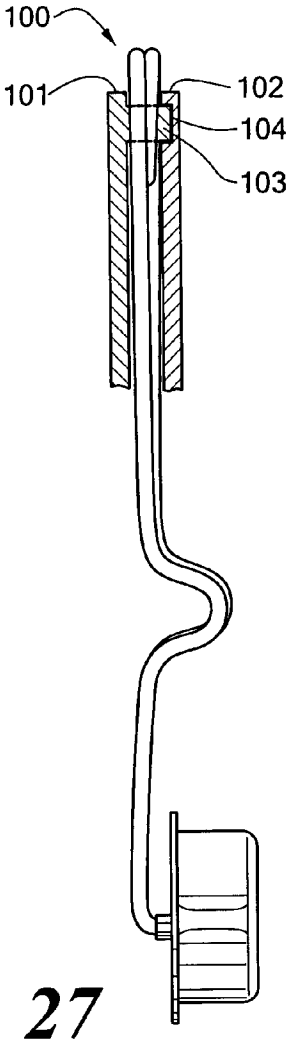
FIG. 27 is a side view of the safety stopper of FIG. 26 showing a partial cross-section of the safety stopper across A—A of FIG. 26.
Figure 26:
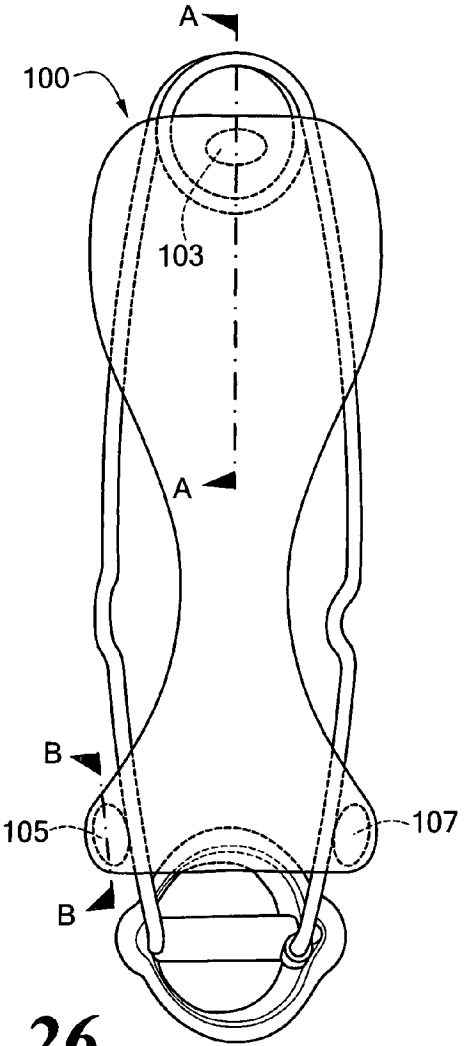
FIG. 26 is a front view of a sixth embodiment of a safety stopper showing the striker sandwiched between two rigid plates.
Figure 32:
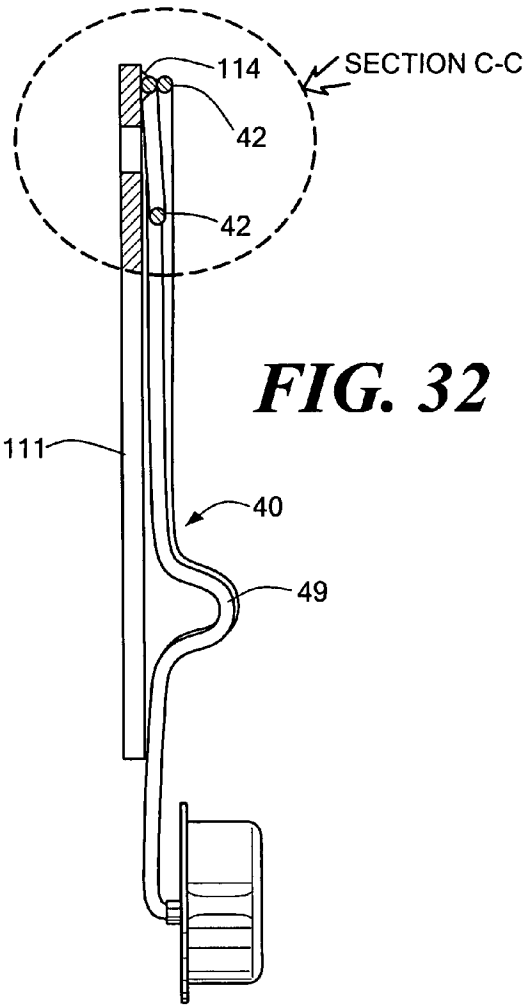
FIG. 32 is a side view of part of striker 40, showing a partial cross section view of the proximate end of safety stopper 110 across C—C of FIG. 29.
Figure 30:
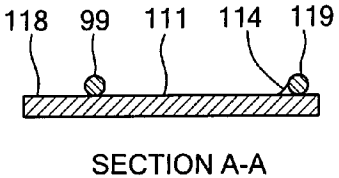
FIG. 30 is a cross section view across A—A of FIG. 29.
Figure 31:
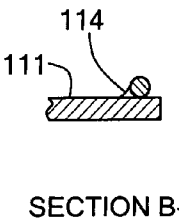
FIG. 31 is a partial cross view across B—B of FIG. 29.
Figure 29:
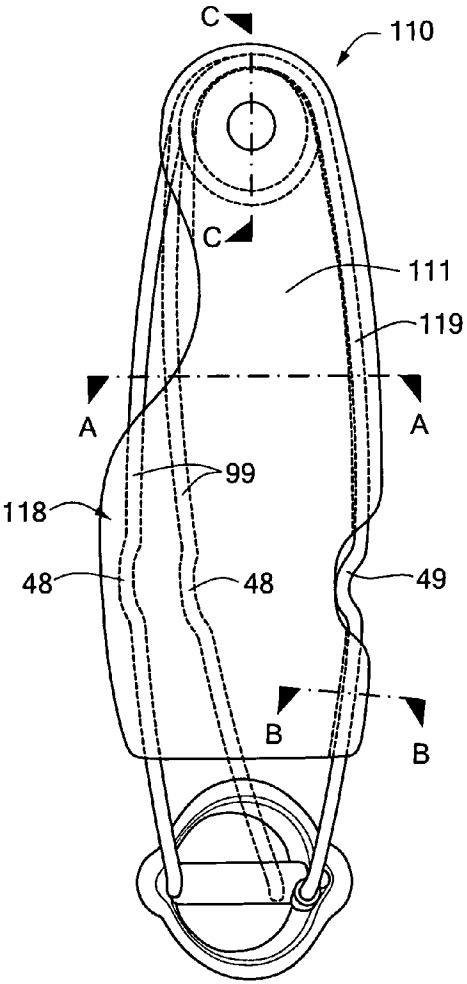
FIG. 29 is a front view of a seventh embodiment of a safety stopper including a single rigid plate tack-welded to one of the two arms.

A sixth embodiment of a safety stopper is illustrated in FIGS. 26–28. In this sixth embodiment, the striker is sandwiched between two rigid clamping plates. FIG. 26 is a front view of safety stopper 100 having a front plate 101 and a rear plate 102. The plates are preferably both made of a rigid, non-flammable, heat-resistant material such as metal or a molded thermo-setting plastic material. FIG. 27 is a side view of the safety stopper of FIG. 26. FIG. 27 includes a partial cutaway view across A—A of FIG. 26 of front plate 101, rear plate 102, proximal spacer 103 and proximal slot 104. Proximal spacer 103 and distal spaces 105 and 107 attach front plate 101 to rear plate 102. The spacers are preferably made of the same material as the plates. In FIGS. 27 and 28, the spacers are shown molded with front plate 101, rear plate 102 having corresponding slots 104 and 106, respectively, for attachment of the front plate to the rear plate. FIG. 27 shows spacer 103 and its corresponding slot 104. FIG. 28 shows spacer 105 pressed into its corresponding slot 106. Spacer 107 is pressed into its corresponding slot (not shown).

A seventh embodiment of the safety stopper (safety stopper 110 shown in FIGS. 29–32) is a rigid metallic plate 111, having an overlapping portion 118 in sliding, overlapping relationship to swinging arm 99. Plate 111 is tack-welded by tack welds 114 to second arm 119.

Figure 33:
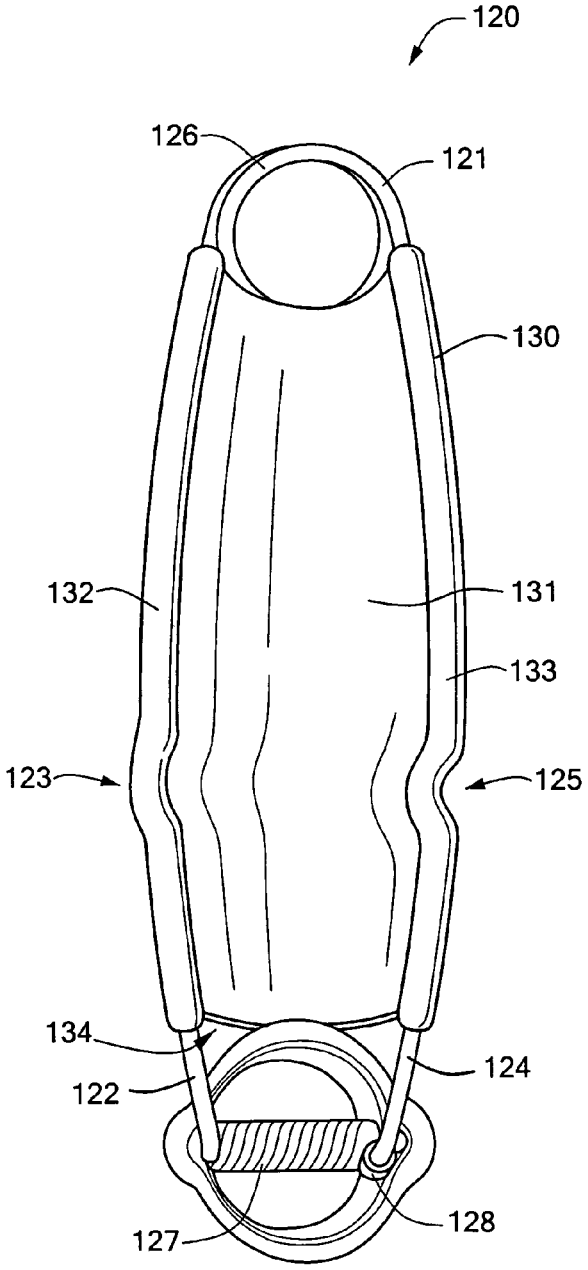
FIG. 33 is a front view of a first preferred embodiment of a welding torch striker with an integral safety stopper in the form of a molded rubber web.
Figure 34:
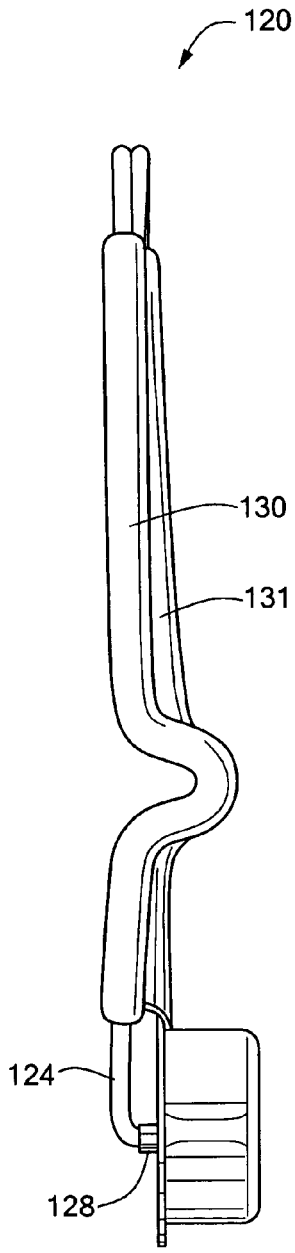
FIG. 34 is a side view of the welding torch striker of FIG. 33.

A first embodiment of a welding torch striker with an integral safety stopper is shown in FIGS. 33 and 34. Welding torch striker with integral safety stopper 120 includes U-shaped spring handle 121. Spring handle 121 defines a first arm 122 with a first push-tab 123 and a second arm 124 with a second push-tab 125. The arms are formed of one piece defining bend 126 at the proximal end of the striker. Strike plate 127 is mounted to the distal end of first arm 122. Flint 128 is mounted to the distal end of second arm 124. U-shaped spring handle 121 and strike plate 127 define an open area between the first and second arms. Integral safety stopper 130 is formed as a web 131 extending between a first handle-grip 132 surrounding a portion of first arm 122, including first push-tab 123, and a second handle-grip 133 surrounding a portion of the second arm 124 including second push-tab 125. Web 131 is approximately 3/32 inch thick, and the adjoining material surrounding a portion of first arm 122, and surrounding a portion of the second arm 124 is also approximately 3/32 inch thick. Web 131 has a tough outer face configured to cover a substantial portion of open area 134.

When an operator is carrying the striker hands-free with the striker attached to the operator's belt, the elongated cover reduces the chances of the striker catching on an external object.

Figure 35:
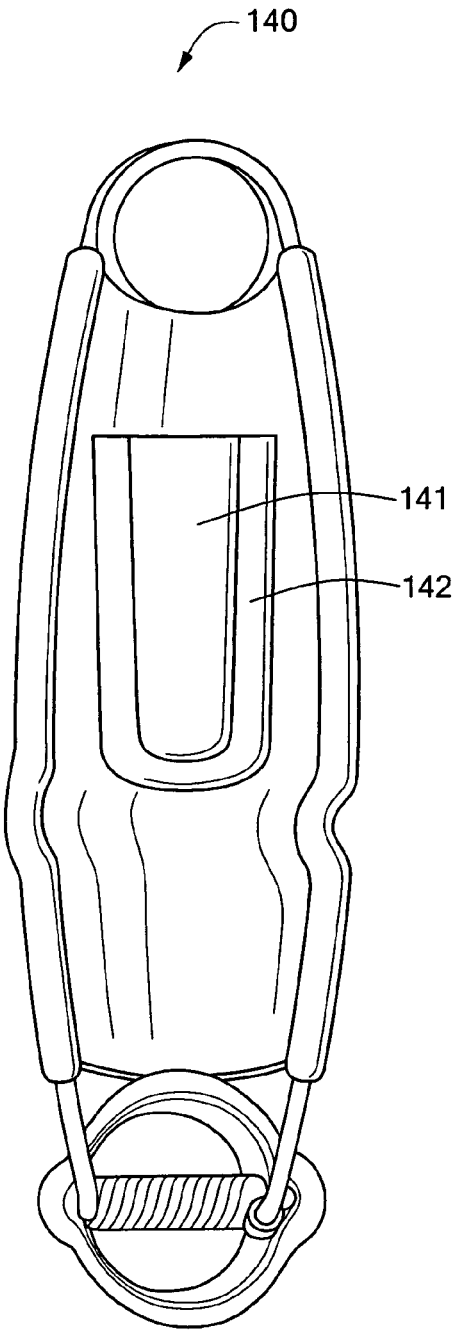
FIG. 35 is a front view of another embodiment of a welding torch striker with an integral safety stopper having two pouches formed as part of a molded rubber web.

A first preferred embodiment of a welding torch striker with an integral safety stopper includes three pouches. The three pouches are preferably formed integrally with the web from the same rubber material as the web. They may be formed by conventional injection molding techniques using a mold having a retractable part to form the inside of a pouch and to impress brand name or other identification into the surface of the web. Unlike the leather pouches described above, the rubber pouches of the first preferred embodiment do not need flaps. They rely on the resilience of the rubber material to hold the spare flints cartridge and other accessories in place. FIG. 35 shows welding torch striker with an integral safety stopper 140 having outer front molded rubber pouch 141, and inner front molded rubber pouch 142, formed on the front face of its molded rubber web.

Figure 36:
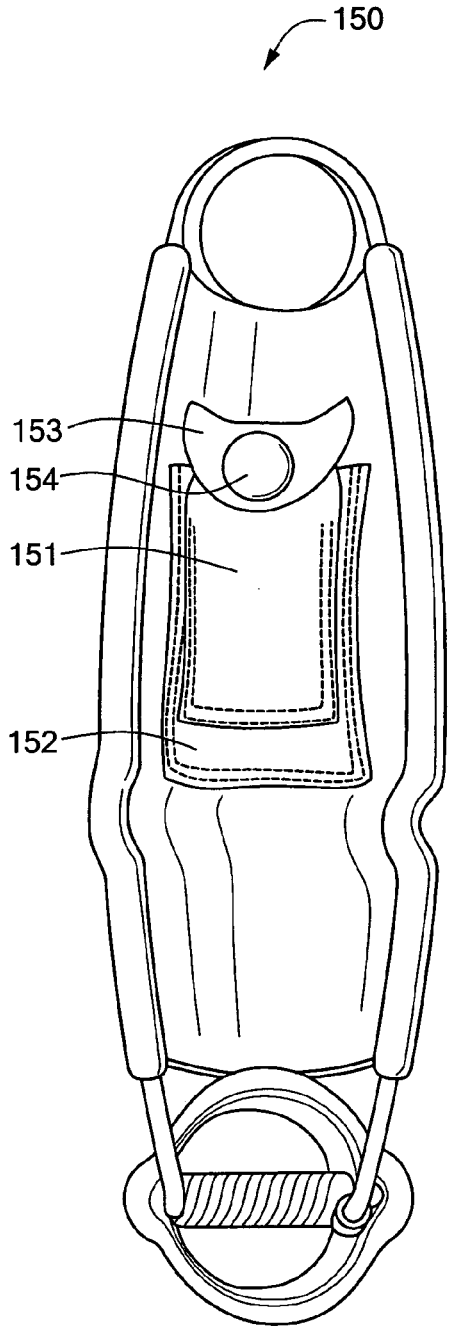
FIG. 36 is a front view of a first preferred embodiment of a welding torch striker with an integral safety stopper having two pouches made of leather attached to a molded rubber web.

Alternatively, embodiments of welding torch strikers that have an integral safety stopper may include stitched-on pouches made of leather. FIG. 36 shows welding torch striker with an integral safety stopper 150 having outer front leather pouch 151, and inner front leather pouch 152, formed on the front face of a molded rubber web, and a shared front flap 153 with a press stud fastener 154.

Another embodiment of a safety striker includes an elongated cover shaped as a sock, the sock attached to the striker by a fastener penetrating the sock near the sock's proximal closed end and passing through the coil of the spring handle.

Another embodiment of a safety striker includes a safety stopper in the form of a rigid plate fastened to a portion of the spring handle at the bend.

Another embodiment of a safety striker includes two rigid plates clamped onto the striker.

Another embodiment of a safety striker includes a safety stopper in the form of a rigid plate tack-welded to one of the two arms, and mounted in sliding, overlapping relationship to the other arm.

Pouches are an important aspect of the invention but they are not essential to the safety function. In alternative embodiments of the invention, the safety stopper has no pouches. Other embodiments include one or more pouches only on the rear for greater safety. Yet other embodiments include one or more pouches on the front for greater convenience.

What is claimed is:

1. A safety stopper for use with a conventional welding torch striker, the striker having a substantially U-shaped spring handle, the spring handle defining a first arm with a first push-tab and a second arm with a second push-tab, the arms formed as one piece with a bend at a proximal end of the striker, a strike plate mounted to a distal end of the first arm, and a flint mounted to a distal end of the second arm, the spring handle and the strike plate defining an open area, the safety stopper comprising:

a sleeve made of a flexible, non-flammable, heat-resistant material;

wherein the sleeve is shaped to enclose a central portion of both arms, while providing space for relative movement within the sleeve of the first push-tab with respect to the second push-tab;

wherein the sleeve is sized for retention on the arms by spring force exerted outward on the sleeve by the arms; and wherein the sleeve is shaped to cover a substantial portion of the open area, and to expose the strike plate and the flint;

such that the safety stopper, when attached to the striker, defines a clear path for movement of the striker plate with respect to the flint;

such that the safety stopper allows manual operation of the striker while the safety stopper is attached to the striker; and such that the safety stopper reduces the chances of the operator being thrown off balance by the striker catching on an external object when the striker, with the safety stopper attached, is carried hands-free attached to an operator's belt.

2. A safety stopper according to claim 1, wherein the sleeve is formed of a single sheet of material folded to produce a fold and first and second open edges, the first and second open edges attached by stitching.

3. A safety stopper according to claim 2, wherein the sleeve is made of leather.

4. A safety stopper according to claim 1, wherein the bend at the proximal end of the striker protrudes beyond the proximal end of the sleeve.

5. A safety stopper according to claim 1, further comprising at least one pouch attached to the sleeve.

6. A safety stopper according to claim 5, wherein at least one pouch is made of leather.

7. A safety stopper for use with a welding torch striker, the striker having a substantially U-shaped spring handle, the spring handle defining a first arm with a first push-tab and a strike plate mounted to a distal end of the first arm, and a second arm with a second push-tab and a flint mounted to a distal end of the second arm, the arms joined to form a bend at a proximal end of the striker, the spring handle and the strike plate defining an open area, the safety stopper adapted for attachment to the striker, the safety stopper including a cover wherein said cover is a structure selected from the group consisting of a sleeve, a sock, a plate and a molded web, and wherein said safety stopper is shaped to cover a substantial portion of the open area, and to expose the strike plate and the at least one flint;

such that the safety stopper, when attached to the striker, defines a clear path for movement of the strike plate with respect to the flint;

such that the safety stopper allows manual operation of the striker while the safety stopper is attached to the striker; and such that the safety stopper reduces the chances of the operator being thrown off balance by the striker catching on an external object when the striker, with the safety stopper attached, is carried hands-free attached to an operator's belt.

8. A safety stopper according to claim 7, wherein the sock is made of a flexible, non-flammable, heat-resistant material;

wherein the sock is shaped to enclose a proximate and central portion of both arms, while providing space for relative movement within the sock of the first push-tab with respect to the second push-tab;

wherein the sock is shaped to cover a substantial portion of the open area, while exposing the strike plate and the flint; and wherein the sock is attached to the striker by at least one rivet penetrating the sock.

9. A safety stopper according to claim 8, wherein the at least one rivet penetrates the sock near the sock's distal open end.

10. A safety stopper according to claim 8, further comprising a grommet, wherein the grommet penetrates the sock near the sock's proximal closed end.

11. A safety stopper according to claim 7, the safety stopper further comprising a rigid plate made of a non-flammable, heat-resistant material shaped to cover a substantial portion of the open area, while exposing the strike plate and the flint.

12. A safety stopper according to claim 11, further comprising at least one clip-on fastener adapted to clip the rigid plate to a portion of the spring handle proximate to the bend.

13. A safety stopper according to claim 12, wherein the at least one clip-on fastener is two clip-on fasteners.

14. A safety stopper according to claim 11, wherein the rigid plate has at least one peripheral groove along a first long edge.

15. A safety stopper according to claim 14, wherein a portion of the peripheral groove is adapted to secure the proximal end of the rigid plate within the bend of the striker.

16. A safety stopper according to claim 14, wherein the rigid plate includes an overlapping portion along its second long edge.

17. A safety stopper according to claim 11, further comprising a second rigid plate, the two rigid plates configured for clamp-on attachment of the plates to the striker.

18. A safety stopper according to claim 17, wherein the first rigid plate has at least one integral spacer and the second rigid plate has at least one socket sized to accept the at least one integral spacer.

19. A safety stopper according to claim 11, wherein the rigid plate is a metal plate tack-weld to one of the two arms, and mounted in sliding, overlapping relationship to the other one of the two arms.

20. A welding torch striker with safety stopper according to claim 7, wherein the safety stopper is formed as a one-piece integral safety stopper including a web, a first handle-grip and a second handle-grip;

wherein the web extends between the first handle-grip and the second handle-grip; and wherein the first handle-grip surrounds a portion of the first arm and the second handle-grip surrounds a portion of the second arm.

21. A welding torch striker with safety stopper according to claim 20, wherein the integral safety stopper is made of a flexible, non-flammable, high-temperature resistant rubber.

22. A welding torch striker with integral safety stopper according to claim 21, wherein the integral safety stopper is made by injection molding.

23. A welding torch striker with safety stopper according to claim 22, further comprising at least one pouch formed as part of the one-piece integral safety stopper.

24. A welding torch striker with safety stopper according to claim 20, further comprising at least one pouch made of leather attached to the integral safety stopper.

25. A welding torch striker with safety stopper, comprising:

a substantially U-shaped spring handle, the spring handle defining a first arm with a first push-tab and a strike plate mounted to a distal end of the first arm, and a second arm with a second push-tab and a flint mounted to a distal end of the second arm, the arms joined to form a bend at a proximal end of the striker, the spring handle and the strike plate defining an open area; and a safety stopper adapted for attachment to the striker, the safety stopper including a cover, wherein said cover is a structure selected from the group consisting of a sleeve, a sock, a plate and a molded web, and wherein said cover is shaped to cover a substantial portion of the open area and to expose the strike plate and the at least one film;

such that the safety stopper, when attached to the striker, defines a clear path for movement of the strike plate with respect to the flint;

such that the safety stopper allows manual operation of the striker while the safety stopper is attached to the striker; and such that the safety stopper reduces the chances of the operator being thrown off balance by the striker catching on an external object when the striker, with the safety stopper attached, is carried hands-free attached to an operator's belt.

26. A welding torch striker with safety stopper according to claim 25, wherein the safety stopper is shaped as a sock, and wherein the sock is attached to the spring handle by a fastener penetrating the sock near the sock's closed end and passing through the coil of the spring handle.

27. A welding torch striker with safety stopper according to claim 25, wherein the safety stopper includes a rigid plate attached to one of the first and second arms such that the rigid plate may move in sliding, overlapping relationship to the other arm of the first and second arms.

28. A welding torch striker with a safety stopper according to claim 27, wherein the rigid plate is a metal plate tack-welded to the one of the first and second arms.

29. A welding torch striker with safety stopper according to claim 25, wherein the safety stopper includes two rigid plates clamped onto the striker.

30. A safety stopper for use with a conventional welding torch striker, the striker having a substantially U-shaped spring handle, the spring handle defining a first arm with a first push-tab and a second arm with a second push-tab, the arms formed as one piece with a bend at a proximal end of the striker, a strike plate mounted to a distal end of the first arm, and a flint mounted to a distal end of the second arm, the spring handle and the strike plate defining an open area, the safety stopper comprising:

a sleeve made of a flexible, non-flammable, heat-resistant material;

wherein the sleeve is shaped to enclose a central portion of both arms, while providing space for relative movement within the sleeve of the first push-tab with respect to the second push-tab;

wherein the sleeve is shaped and sized for retention on the arms by enclosing a central portion of both arms; and wherein the sleeve is shaped to cover a substantial portion of the open area, while exposing the strike plate and the flint;

such that the safety stopper, when attached to the striker, defines a clear path for movement of the strike plate with respect to the flint such that the safety stopper allows manual operation of the striker while the safety stopper is attached to the striker; and such that the safety stopper reduces the chances of the operator being thrown off balance by the striker catching on an external object when the striker, with the safety stopper attached, is carried hands-free attached to a operator's belt.

31. A safety stopper according to claim 30, wherein the sleeve is formed of a single sheet of material folded to produce a fold and first and second open edges, the first and second open edges attached by stitching.

32. A safety stopper according to claim 31, wherein the sleeve is made of leather.

33. A safety stopper according to claim 30, wherein the bend at the proximal end of the striker protrudes beyond the proximal end of the sleeve.

34. A safety stopper according to claim 30, further comprising at least one pouch attached to the sleeve.

35. A safety stopper according to claim 34, wherein at least one pouch is made of leather.

* * * * *